US008783056B2

(12) United States Patent
Kim

(10) Patent No.: US 8,783,056 B2
(45) Date of Patent: Jul. 22, 2014

(54) REFRIGERATOR

(75) Inventor: Ung-Su Kim, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 1681 days.

(21) Appl. No.: 12/296,884

(22) PCT Filed: Apr. 12, 2007

(86) PCT No.: PCT/KR2007/001770
§ 371 (c)(1),
(2), (4) Date: Mar. 10, 2010

(87) PCT Pub. No.: WO2007/119963
PCT Pub. Date: Oct. 25, 2007

(65) Prior Publication Data

US 2010/0154460 A1 Jun. 24, 2010

(30) Foreign Application Priority Data

Apr. 14, 2006 (KR) ..... 10-2006-0034222

(51) Int. Cl.
*F25D 17/04* (2006.01)

(52) U.S. Cl.
USPC ..... 62/408; 62/426

(58) Field of Classification Search
USPC ..... 62/426, 408; 312/402, 404, 408
See application file for complete search history.

(56) References Cited

U.S. PATENT DOCUMENTS

| | | | | |
|---|---|---|---|---|
| 4,732,014 | A * | 3/1988 | Frohbieter | 62/382 |
| 5,947,573 | A * | 9/1999 | Tovar et al. | 312/404 |
| 6,604,377 | B2 * | 8/2003 | Kameda et al. | 62/408 |
| 6,612,116 | B2 * | 9/2003 | Fu et al. | 62/3.6 |
| 6,675,603 | B1 * | 1/2004 | Lesyna et al. | 62/407 |
| 2004/0182105 | A1 * | 9/2004 | Nam et al. | 62/408 |
| 2005/0236947 | A1 * | 10/2005 | LeClear et al. | 312/404 |
| 2006/0191285 | A1 * | 8/2006 | Rand et al. | 62/408 |

FOREIGN PATENT DOCUMENTS

| | | | |
|---|---|---|---|
| KR | 20-1996-0038196 | U | 12/1996 |
| KR | 10-1998-0025949 | A | 7/1998 |
| KR | 10-2000-0033193 | A | 6/2000 |
| KR | 10-2003-0021876 | A | 3/2003 |
| KR | 10-0756512 | | 9/2007 |
| WO | WO 2007/119963 | A1 | 10/2007 |

* cited by examiner

*Primary Examiner* — Cassey D Bauer
(74) *Attorney, Agent, or Firm* — Birch, Stewart, Kolasch & Birch, LLP

(57) ABSTRACT

A refrigerator includes: a refrigerator body having a food storage space; a door opening/closing the storage space; a heat exchange chamber provided inside the refrigerator body and in which an evaporator is installed; an ultra-low-temperature storage separately provided in the storage space; and a supply unit directly supplying cooling air generated from the heat exchange chamber to the ultra-low-temperature storage.

3 Claims, 2 Drawing Sheets

REFRIGERATOR

TECHNICAL FIELD

The present invention relates to a refrigerator.

BACKGROUND ART

Due to the trend of making large refrigerators, side-by-side type refrigerators are commercialized. A side-by-side type refrigerator includes a freezing chamber and a refrigerating chamber arranged side by side, a refrigerator body partitioned by a barrier, and a freezing chamber door and a refrigerating chamber door rotatably connected on the front of the refrigerator body to open/close the freezing chamber and the refrigerating chamber.

Specifically, the freezing chamber and the refrigerating chamber include a plurality of shelves on which foods are placed. A plurality of casings are installed inside the freezing chamber and the refrigerating chamber to define a receiving space where foods are preserved. The casing is generally designed to be withdrawn in a drawer type, such that foods are put in or taken out through the opening upper portion of the casing.

According to a related art refrigerator, the internal temperature of the casings provided in the freezing chamber and the refrigerating chamber are maintained at a level substantially equal to the temperature of the space where the casing is installed. For example, the internal temperature of the casing installed inside the freezing chamber is maintained at a level substantially equal to the internal temperature of the freezing chamber.

Therefore, the related art refrigerator has a problem in that the internal temperature of the casing cannot be maintained to be lower than the temperature of the refrigerator.

However, the internal temperature of the casing needs to be maintained at the ultra-low-temperature state, which is lower than the internal temperature of the refrigerator by tens degree Celsius, according to kinds of foods or other reasons.

A separate freezing cycle may be provided in order to differently maintain the internal temperature of the refrigerator and the internal temperature of the casing installed in the refrigerator. However, this method increases a manufacturing cost. In addition, a manufacturing process is complicated and a weight of a product is increased.

DISCLOSURE OF INVENTION

Technical Problem

An object of the present invention is to provide a refrigerator in which the internal temperature of the refrigerator and the internal temperature of the food storage separately provided in the refrigerator are maintained at different levels.

For example, a storage provided in a freezing chamber maintains an ultra-low-temperature state of below −35° C.

Technical Solution

According to an aspect of the present invention, there is provided a refrigerator including: a refrigerator body having a food storage space; a door opening/closing the storage space; a heat exchange chamber provided inside the refrigerator body and in which an evaporator is installed; an ultra-low-temperature storage separately provided in the storage space; and a supply unit directly supplying cooling air generated from the heat exchange chamber to the ultra-low-temperature storage.

According to another aspect of the present invention, there is provided a refrigerator including: a freezing chamber and a refrigerating chamber partitioned by a barrier; a heat exchange chamber disposed in the rear of the freezing chamber and receiving an evaporator for generating cooling air; an ultra-low-temperature casing inserted/withdrawn into/from the freezing chamber; and a connecting unit directly connecting the heat exchange chamber to the ultra-low-temperature casing.

According to further another aspect of the present invention, there is provided a refrigerator including: a refrigerator body including a refrigerating chamber keeping foods at a refrigerating state and a freezing chamber keeping foods at a freezing state; an ultra-low-temperature casing separately provided inside the freezing chamber; and a cooling air generator generating a cooling air, wherein the refrigerator body includes: a first cooling air supply passage supplying the cooling air generated from the cooling air generator to the refrigerating chamber; a second cooling air supply passage supplying the cooling air generated from the cooling air generator to the freezing chamber; and a third cooling air supply passage directly supplying the cooling air generated from the cooling air generator to ultra-low-temperature casing.

Advantageous Effects

According to the present invention, the internal temperature of the refrigerator and the internal temperature of the food storage separately provided in the refrigerator can be maintained at different levels, thereby increasing the utilization of the refrigerator.

Specifically, since the internal temperature of the casing provided inside the freezing chamber to store foods can be maintained at the ultra-low-temperature state, various kinds of foods can be maintained at an appropriate temperature.

In addition, since foods required to be kept at the ultra-low-temperature state can be preserved in the refrigerator, the refrigerator can be used for various purposes.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
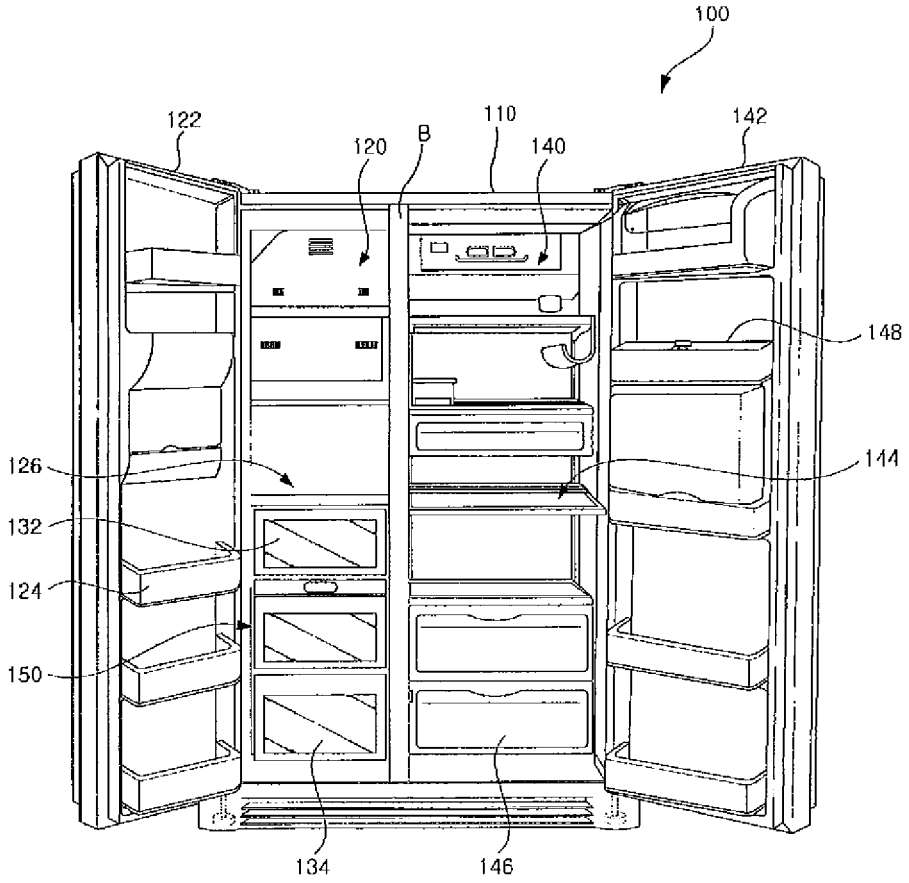
FIG. 1 is a perspective view of a refrigerator having an ultra-low-temperature storage according to an embodiment of the present invention.

FIG. 1 is a perspective view of a refrigerator having an ultra-low-temperature chamber according to an embodiment of the present invention.

Referring to FIG. 1, the refrigerator 100 includes a refrigerator body 110 having a freezing chamber 120 and a refrigerating chamber 140, and a freezing chamber door 122 and a refrigerating chamber door 142 rotatably connected to the front of the refrigerator chamber 110 to open/close the freezing chamber 120 and the refrigerating chamber 140. The freezing chamber 120 and the refrigerating chamber 140 are partitioned left and right by a barrier B.

Specifically, the refrigerating chamber 140 includes a plurality of shelves 144 on which foods required to be refrigerated are placed, and a casing 146 preserving vegetables or fruits. In addition, a plurality of door baskets 148 storing foods are mounted on the rear surface of the refrigerating chamber door 142.

A plurality of door baskets 124 storing water or beverage bottles are mounted on the rear surface of the freezing chamber door 122. In addition, a plurality of shelves 126 are mounted on the freezing chamber 20.

Meanwhile, an ultra-low-temperature storage 150 maintaining an ultra-low-temperature state is installed inside the freezing chamber 120. Specifically, cooling air generated from an evaporator is directly supplied to the ultra-low-temperature storage 150, such that the ultra-low-temperature storage 150 maintains an ultra-low-temperature state of below tens degrees Celsius (e.g., −35° C.). Therefore, the ultra-low-temperature storage 150 can store foods at the ultra-low-temperature state.

Storage casings 132 and 134 are installed above and under the ultra-low-temperature storage 150 to maintain a low-temperature state due to cooling air supplied from to the freezing chamber 120 along cooling air supply paths.

Figure 2:
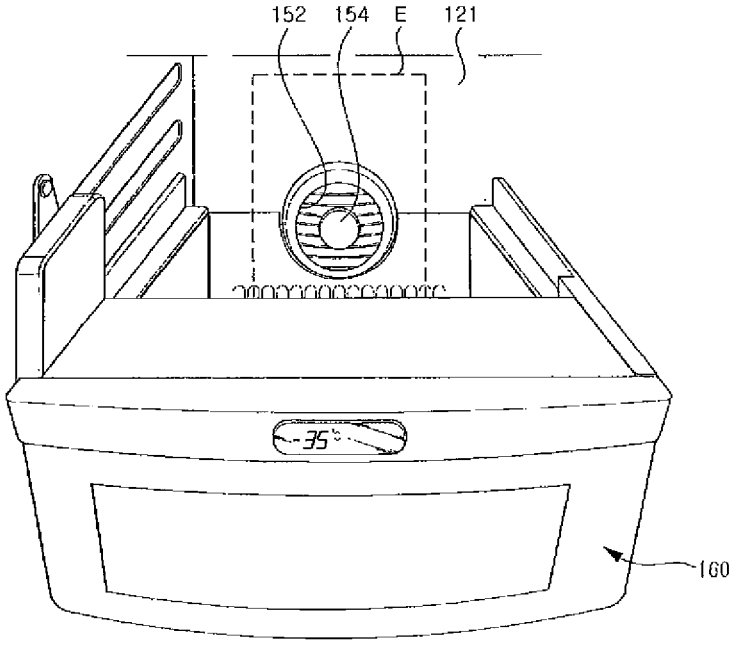
FIG. 2 is a partial perspective view of the ultra-low-temperature storage according to an embodiment of the present invention.

FIG. 2 is a partial perspective view of the ultra-low-temperature storage according to an embodiment of the present invention.

Referring to FIG. 2, a communication opening 152 is formed in the rear surface of an inner case 121 in the freezing chamber 120. The ultra-low-temperature storage 150 includes an ultra-low-temperature casing 160 to which ultra-low-temperature cooling air is supplied from the communication opening 152. A heat exchange chamber is provided in the rear surface of the freezing chamber 120 to receive the evaporator E. Specifically, the communication opening 152 serves as a path connecting the ultra-low-temperature storage 150 to the heat exchange chamber. The communication opening 152 is provided in the front of the evaporator, so that the ultra-low-temperature cooling air generated from the evaporator E can be directly discharged to the ultra-low-temperature storage 150.

In addition, a blower fan 154 is installed in the communication opening 152. Specifically, the blower fan 154 is provided to directly supply the cooling air generated by the contact with evaporator E to the ultra-low-temperature casing 160. That is, the blower fan 154 is installed such that the ultra-low-temperature cooling air generated by the contact with the evaporator E is directly supplied to the ultra-low-temperature storage 150.

Hereinafter, the structure of the ultra-low-temperature storage will be described in more detail with reference to the accompanying drawings.

Figure 3:
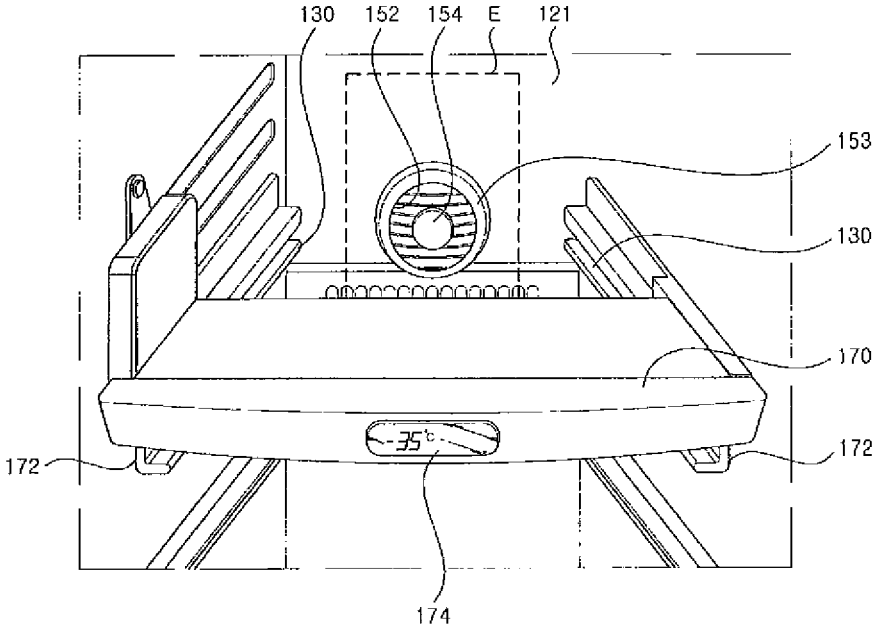
FIG. 3 is a front perspective view of the ultra-low-temperature storage according to an embodiment of the present invention.

FIG. 3 is a front perspective view of the ultra-low-temperature storage according to an embodiment of the present invention.

Referring to FIG. 3, the ultra-low-temperature storage 150 includes a communication opening 152 through which an ultra-low-temperature cooling air is discharged. A blower fan 154 is installed in the communication opening 152. The blower fan 154 is provided independently of a blower fan for discharging cooling air from a heat exchange chamber to the entire freezing chamber.

In addition, a cylindrical protrusion guide 153 protruding forwards from the rear surface of an inner case 121 is formed in a periphery of the communication opening 152. Specifically, the protrusion guide 153 is seated on a guide flange (164 in FIG. 4) formed in the rear side of the ultra-low-temperature casing 160. Therefore, all the ultra-low-temperature cooling air from the communication opening 152 is supplied into the ultra-low-temperature casing 160 without leaking to the outside of the ultra-low-temperature casing 160, i.e., the freezing chamber.

Meanwhile, support rails 130 are formed on sides of the inner case 121 to support the both sides of the ultra-low-temperature casing 160. A front cover 170 is formed at a predetermined front portion of the support rails 130 to cover a portion of an upper opening of the ultra-low-temperature casing 160. Support guides 172 are formed at a front lower portion of the front cover 170 to guide the insertion of the ultra-low-temperature casing 170. The support guides 172 are continuously formed in line with the support rails 130. Therefore, the ultra-low-temperature casing 160 is inserted in such a state that it is held on the support guides 172. When the ultra-low-temperature casing 160 is inserted into a predetermined distance, its insertion is guided by the support rails 130.

In addition, a display device 174 is installed in the front cover 174. The display device 174 allows the user to know the internal state of the ultra-low-temperature casing 160. For example, if a temperature sensor (not shown) is installed in the ultra-low-temperature casing 160 and the display device is designed to display a temperature value detected by the temperature sensor, the user can visually check the internal temperature of the ultra-low-temperature casing 160.

If the temperature sensor is installed in the ultra-low-temperature casing 160, it is possible to control the supply of ultra-low-temperature cooling air to the ultra-low-temperature casing 160 based on the temperature value detected by the temperature sensor. That is, a reference value of the internal temperature of the ultra-low-temperature casing 160 is set (e.g., −35° C.), and a controller of the refrigerator controls whether to drive the blower fan 154 based on the temperature value detected by the temperature sensor. For example, when the internal temperature of the ultra-low-temperature casing 160 is higher than the reference value, the controller drives the blower fan to supply the ultra-low-temperature cooling air to the ultra-low-temperature casing 160. On the other hand, when the internal temperature of the ultra-low-temperature casing 160 is lower than the reference value, the controller stops the blower fan. In this way, the internal temperature of the ultra-low-temperature casing 160 can be appropriately maintained.

As another embodiment of the ultra-low-temperature storage, a structure having no front cover 170 can be provided. In such a structure, the support rails 130 extend up to the front end of the support guides 172. In this case, the ultra-low-temperature casing 160 is supported by the support rails 130 from the beginning of the insertion. In addition, an upper opening of the ultra-low-temperature casing 160 is shielded by a casing 132 provided above the ultra-low-temperature casing 160.

Figure 4:
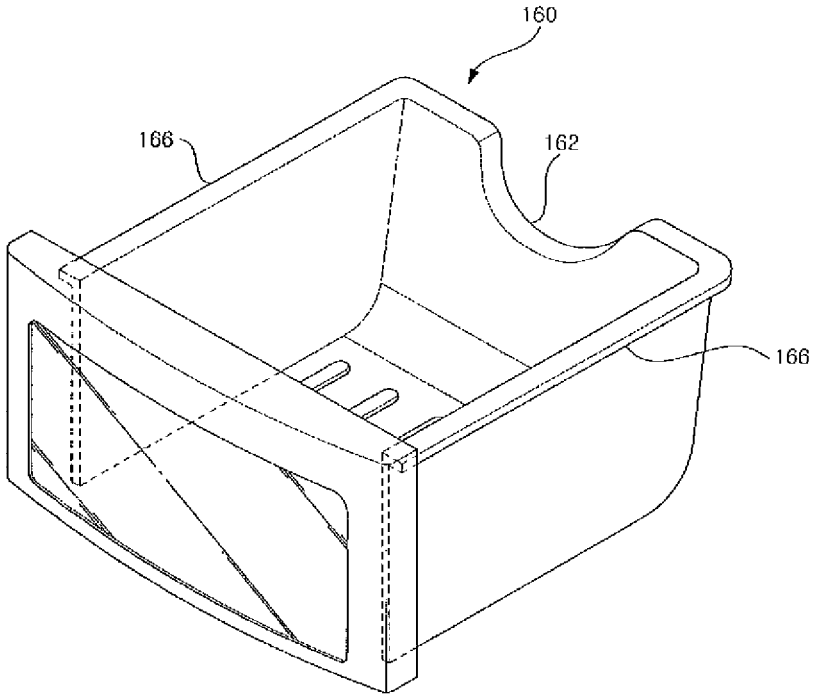
FIG. 4 is a perspective view of an ultra-low-temperature casing of the ultra-low-temperature storage according to an embodiment of the present invention.

FIG. 4 is a perspective view of the ultra-low-temperature casing of the ultra-low-temperature storage according to an embodiment of the present invention.

Referring to FIG. 4, the ultra-low-temperature casing 160 has a predetermined receiving space defined therein and its upper portion is opened.

Specifically, the ultra-low-temperature casing 160 has a drawer-like opening/closing structure so that it is withdrawn forwards. Thus, the ultra-low-temperature casing 160 has a container shape having an opened upper side. Flange guides 166 are formed to horizontally extend on both upper edge portions of the ultra-low-temperature casing 160. The flange guides 166 are supported by the support rails 130 or the support guides 172. In other words, the bottom surfaces of the flange guides 166 are seated on the top surfaces of the support guides 172 so as to insert the ultra-low-temperature casing 160. In such a state, when the ultra-low-temperature casing 160 is pushed inwardly, the flange guides 166 are slidingly inserted inwardly along the support rails 130.

In addition, a recess 162 is formed to a predetermined depth at the rear upper portion of the ultra-low-temperature casing 160.

Specifically, the recess 162 is curved with the same curvature as an outer diameter of the protrusion guide 153, so that a portion of the periphery of the protrusion guide 153 is seated thereon. Therefore, the cooling air discharged from the communication opening 152 is prevented from leaking to the outside of the ultra-low-temperature casing 160.

As another embodiment, a circular hole having the same diameter as the outer diameter of the protrusion guide 153 may be formed at the rear side of the ultra-low-temperature casing 160. That is, since the protrusion guide 153 is wholly inserted into the hole, the leakage of the cooling air can be perfectly prevented. This is because the support rails 130 are formed at positions above the protrusion guide 153.

Hereinafter, the entire flow of the cooling air in the refrigerator having the ultra-low-temperature casing 160 will be described in detail.

When the refrigerator begins to operate, cooling air is generated from the evaporator disposed inside the heat exchange chamber provided in the rear side of the freezing chamber 12. The generated cooling air is supplied to the freezing chamber 120, the refrigerating chamber 140, and the ultra-low-temperature casing 160.

The path of the cooling air supplied to the freezing chamber 120 and the refrigerating chamber 140 is identical to that of the related art. That is, the cooling air generated from the heat exchange chamber is supplied to the freezing chamber by a separate blower fan (not shown). Specifically, the cooling air passing through the evaporator ascends along the cooling air passage (not shown) formed in the rear of the freezing chamber 120 and is supplied to the freezing chamber 120 through the cooling air outlet formed in the upper portion of the freezing chamber 120. The supply of the cooling air to the refrigerating chamber 140 is guided into the refrigerating chamber 140 through the cooling air outlet formed in the upper portion of the refrigerating chamber 140 along a separate passage.

A portion of the cooling air generated from the heat exchange chamber is supplied to the ultra-low-temperature storage 150 through the communication opening 152. The communication opening 152 is installed adjacent to the evaporator E, such that the blower fan 154 can directly supply the ultra-low-temperature cooling air generated from the evaporator E to the ultra-low-temperature storage 150. Therefore, the ultra-low-temperature storage 150 can be maintained at the desired ultra-low-temperature state.

The protrusion guides 153 protruding forwards around the communication opening 152 protrude inside the ultra-low-temperature casing 160 such that at least a portion of the protrusion guides 153 come in contact with the recess 162 formed at the rear side of the ultra-low-temperature casing 160 of the ultra-low-temperature storage 150. Therefore, the ultra-low-temperature cooling air supplied into the ultra-low-temperature storage 150 by the blower fan 154 is directly guided into the ultra-low-temperature storage 150 without leakage of the cooling air.

The freezing chamber 120 and the refrigerating chamber 140 are partitioned by the barrier B installed vertically. The cooling air supplied into the ultra-low-temperature storage 150 and circulating the inside of the ultra-low-temperature storage 150 may be supplied into the refrigerating chamber 140. Specifically, the cooling air outlet may be formed in the barrier B corresponding to the location of the ultra-low-temperature storage 150, so that the cooling air, a temperature of which relatively rises while circulating the ultra-low-temperature storage 150, is guided to the refrigerating chamber 140. A casing (e.g., a vegetable tray) keeping fruits or vegetables fresh may be disposed in the refrigerating chamber 140 adjacent to the cooling air outlet of the barrier B, so that the cooling air circulating the ultra-low-temperature storage 150 can be directly supplied thereto.

The operation of controlling whether to supply the cooling air to the freezing chamber 120 and the refrigerating chamber 140 is identical to that of the related art. For example, the supply of the cooling air to the freezing chamber 120 is controlled based on the temperature value detected by the temperature sensor installed inside the freezing chamber 120, and the supply of the cooling air to the refrigerating chamber 140 is controlled based on the temperature value detected by the temperature sensor installed inside the refrigerating chamber 140. In addition, the display device 174 installed in the front of the front cover 170 covering the top of the ultra-low-temperature casing 160 can inform the user of the current temperature of the ultra-low-temperature storage 150.

The supply of the cooling air to the ultra-low-temperature storage 150 is controlled based on the temperature value of the ultra-low-temperature storage 150, which is detected by the temperature sensor (not shown) installed therein. For example, the blower fan 154 is stopped when the internal temperature of the ultra-low-temperature storage 150 is lower than the set temperature. On the other hand, when the internal temperature of the ultra-low-temperature storage 150 is higher than the set temperature, the blower fan 154 is driven to supply the ultra-low-temperature cooling air to the ultra-low-temperature storage 150.

As described above, the refrigerator according to the present invention includes the ultra-low-temperature storage that maintains the ultra-low-temperature state because the ultra-low-temperature cooling air is directly supplied from the evaporator, as well as the cooling air supply paths through which the cooling air is respectively supplied to the freezing chamber and the refrigerating chamber.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the present invention, the internal temperature of the refrigerator and the internal temperature of the food storage separately provided in the refrigerator are maintained at different levels. Therefore, the utilization of the refrigerator is increased and thus its industrial applicability is very high.

The invention claimed is:

1. A refrigerator comprising:

a refrigerator body having a food storage space;

a door opening/closing the storage space;

a heat exchange chamber provided inside the refrigerator body;

an evaporator installed inside the heat exchange chamber;

an ultra-low-temperature storage separably provided in the storage space, the ultra-low-temperature storage disposed in front of the heat exchange chamber; and a supply unit directly supplying cooling air generated from the heat exchange chamber to the ultra-low-temperature storage, the supply unit comprising:

a communication opening directly connecting the heat exchange chamber to the ultra-low-temperature storage, the communication opening disposed in front of the evaporator;

a protrusion guide protruding forwards from a rear surface of an inner case defining the storage space; and a blowing unit installed inside the communication opening to blow the cooling air to the ultra-low-temperature storage, wherein the ultra-low-temperature storage comprises an ultra-low-temperature casing receiving the cooling air discharged through the communication opening, and having a recess in a rear side thereof, such that at least a portion of an outer surface of the protrusion guide is mounted on the recess to directly supply the cooling air in the heat exchange chamber to the ultra-low-temperature storage;

a temperature sensor detecting a temperature in the ultra-low-temperature casing;

a front cover covering at least a portion of an upper opening of the ultra-low-temperature casing, the front cover including:

an upper part covering the portion of the upper opening of the ultra-low-temperature casing when the ultra-low-temperature casing is received in the storage space;

a front part formed at a front end of the upper part to form a portion of a front surface of the ultra-low-temperature storage; and a display device installed on the front part to inform a user of the temperature detected by the temperature sensor; and a controller configured to stop the blowing unit when the temperature detected by the temperature sensor reaches a preset temperature.

2. The refrigerator according to claim 1, wherein the storage space is a freezing chamber located corresponding to the evaporator, and the protrusion guide is formed in a rear side of the freezing chamber between the heat exchange chamber and the ultra-low-temperature storage.

3. The refrigerator according to claim 1, further comprising:

a guide member provided in a side of a freezing chamber at a position where the ultra-low-temperature storage is formed, the guide member guiding forward/rearward sliding of the ultra-low-temperature casing; and a flange guide extending on both upper portions of the ultra-low-temperature casing and sliding along the guide member.

* * * * *